United States Patent [19]

Nikoden, Jr.

[11] 4,088,322

[45] May 9, 1978

[54] TARGET CARRIER PROTECTION SYSTEM

[75] Inventor: Joseph Nikoden, Jr., Inverness, Ill.

[73] Assignee: Detroit Bullet Trap Corporation, Schaumburg, Ill.

[21] Appl. No.: 698,351

[22] Filed: Jun. 22, 1976

[51] Int. Cl.[2] ..... F41J 1/20; F41J 7/00

[52] U.S. Cl. ..... 273/105.6

[58] Field of Search ..... 273/105.6, 105.2, 102.4

[56] References Cited

U.S. PATENT DOCUMENTS

| | | | |
|---|---|---|---|
| 645,229 | 3/1900 | Moller | 273/105.2 |
| 1,061,577 | 5/1913 | Whitney | 273/105.2 |
| 1,266,348 | 5/1918 | Thompson | 273/105.6 |
| 1,281,687 | 10/1918 | Stelling | 273/105.6 |
| 2,104,171 | 1/1938 | Schwerin | 273/105.6 |
| 3,006,648 | 10/1961 | Devitt et al. | 273/105.6 |

FOREIGN PATENT DOCUMENTS

| | | | |
|---|---|---|---|
| 1,319,016 | 1963 | France | 273/105.6 |
| 704 of | 1901 | United Kingdom | 273/105.2 |

*Primary Examiner*—Richard C. Pinkham
*Assistant Examiner*—Lawrence E. Anderson
*Attorney, Agent, or Firm*—Hill, Gross, Simpson, Van Santen, Steadman, Chiara & Simpson

[57] ABSTRACT

A target shooting range having a designated shooter position, at least one target position and a target carrier system. The carrier system includes a rail extending between the shooter position and the target position with a movable target carrier mounted on the rail for movement between those two positions. The movable target carrier has a carriage portion comprising a wheeled vehicle and a lower target holder portion depending from the carriage portion. The lower target holder portion is movable to a retracted position as the carrier is being moved from the shooter position to a target position. Bullet deflection plates are suspended from the ceiling of the range beneath the carrier rail and have the function of protecting the upper carriage portion of the carrier from being struck and gradually destroyed by bullets fired from the shooter position.

7 Claims, 4 Drawing Figures

TARGET CARRIER PROTECTION SYSTEM

BACKGROUND OF THE INVENTION

1. Field of the Invention

The field of art to which this invention pertains is shooting ranges and in particular to shooting ranges with bullet deflection plates to protect various portions of the range from being struck by bullets fired from a designated shooter position. In particular, the invention relates to a retractable target system which is used in combination with ceiling supported deflection plates for protecting the movable target carrier.

2. Description of the Prior Art

Prior art systems have utilized target carriers which are movable at the command of the shooter, for instance, from a shooter position at which the shooter may change the target to a target location position. However, in such prior systems, the target carrier is in direct sight of the shooter and it may be, and often is, frequently struck by bullets fired from the shooter position. Even though the carier may be armored, repeated bullet impact can be damaging to the system and ultimately destroy the target carrier. Accordingly, the present invention provides a means for shielding the target carrier by using stationary-mounted ceiling protective deflection plates.

SUMMARY OF THE INVENTION

It is an important feature of the present invention to provide an improved target carrier system for a shooting range.

It is another feature of the present invention to provide a suitably shielded target carrier for a shooting range.

It is an important object of the present invention to provide a target carrier system for a shooting range where the target carrier is designed to be retractable to be used in combination with ceiling suspended bullet deflection plates to protect the mechanism of the target carrier from bullet impact.

It is another object of the present invention to provide a target carrier system with a carrier rail extending between various target locations and the shooter in combination with a plurality of ceiling suspended bullet deflection plates mounted in the line of signt between the target carrier at any chosen location and the shooter to protect the carrier from being inadvertently or deliberately impacted by bullets fired from the shooter position.

These and other objects, features and advantages of the present invention will be understood in greater detail from the following description and the associated drawings wherein reference numerals are utilized to designate a preferred embodiment.

DESCRIPTION OF THE PREFERRED EMBODIMENT

The present invention relates to a target shooting range and in particular to the improvement of providing means for protecting a movable target carrier from being impacted by bullets fired from a shooter position. Shooting ranges have been known to utilize movable target carrier systems for holding a disposable target in the line of sight of a shooter at various distances from the shooter position. It has been discovered, however, that the carrier system is often impacted by bullets from the shooter either inadvertently or because the carrier itself becomes the attractive target for the shooter. Even though the carrier may be suitably armored, repeated bullet impacts against the system eventually cause the carrier to be destroyed.

The present invention provides a combination of specially arranged bullet deflection plates and a specially designed carrier with the result that the movable target carrier is shielded from the shooter. At the same time the shooter is allowed to command the movable carrier to move to the shooter position so that the shooter can exchange a worn-out target for a new target of the shooter's choice. However, soon after the target is changed, the carrier itself disappears from the line of sight of the shooter making it impossible for the shooter to fire directly at the carrier.

Figures 1, 1A:
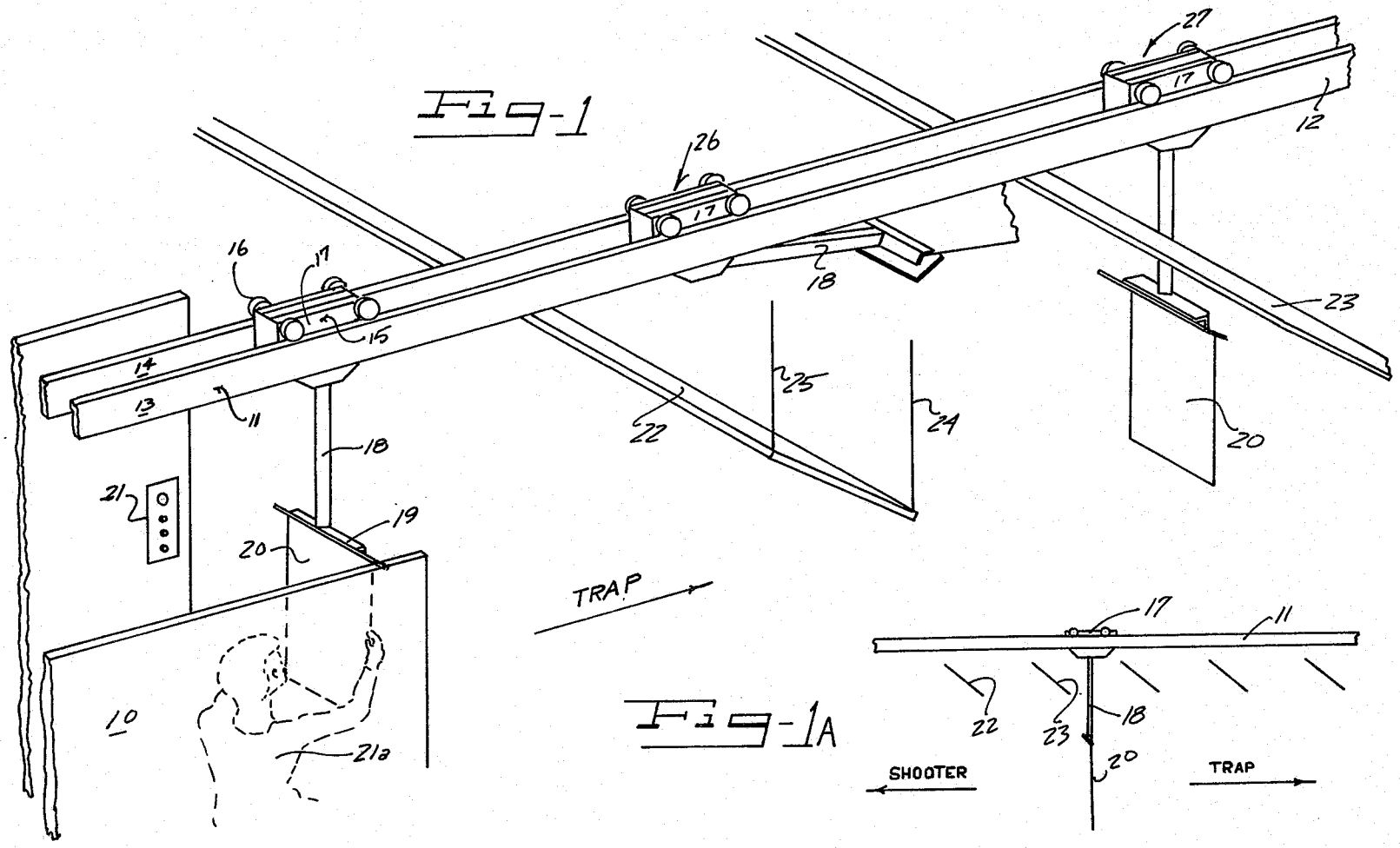
FIG. 1 is a perspective of a shooting range showing shooter and target positions as well as an intermediate position of a target carrier according to the present invention with the target holder portion of the carrier in a retracted mode to permit the carrier to be moved clear of ceiling-suspended bullet deflection plates.
FIG. 1A is a side view of a shooting range showing the target carrier in a stopped position with the target holder portion in a lowered position.

Referring specifically to FIG. 1, there is shown a shooting range which, in undescribed respects, is well known in the art. In FIG. 1 however, the material features of the invention are shown. There is shown a shooter position at a shooter booth designated by the numeral 10. An overhead rail 11 extends from the shooter position rearwardly to various desired target positions. The rail is shown as extending only to a point 12, however, it is understood that the rail continues to a point located adjacent to a bullet collection apparatus normally stationed to receive and collect the spent bullets.

In this embodiment, the rail 11 consists of two spaced rail sections 13 and 14, between which there is disposed a movable target carrier 15. The target carrier 15 is supported on wheels 16. The carrier 15 may be of a type well known in the art and may be moved along the rails 13 and 14 according to standard prior art methods.

The movable target carrier 15 has an upper carrier portion 17 and a lower target portion 18 terminating in a target clamp 19, which is also well known in the prior art. The clamp 19 is arranged to removably support a paper or other disposable type target 20. In this case a shooter 21 is shown positioning a new target 20 in the clamp 19. As is well known in the art, the shooter may then operate a number of controls in a control panel 21 to move the carrier 15 to a specific location along the rail 11.

Only one such carrier is located along a given rail, however, in FIG. 1 the carrier is illustrated at two other positions to demonstrate the functioning of the system according to the invention.

A plurality of bullet deflection plates such as 22 and 23 are suspended by cable such as at 24 and 25 from the ceiling of the shooting range, and they are positioned beneath the rail 11. FIG. 1A shows their location with respect to both the shooter and the instantaneous position of the target carrier 17. This arrangement maintains the target carrier 15 (the upper portion 17) out of the line of sight of the shooter. The deflection plates 22 and 23 are maintained at an oblique angle with respect to the shooter to deflect bullets in a rearward direction safely away from both the shooter and the upper carriage portion 17 of the carrier.

The plates 22 and 23 are positioned sufficiently close to the rail 11 to protect the upper carriage portion 17, and means are provided to retract the carrier for free movement between various positions along the rail. In the position 26 the lower target holder portion 18 of the carrier is in its retracted position. When in this position, the target carrier can move freely from the shooter position to any target position and yet clear the deflection plates 22 and 23.

When the target carrier arrives at the desired target position such as 27, the target holder portion is lowered as indicated by the arrow 28. Then, the target 20 is in direct line of sight with the shooter, however, the upper carriage portion 17 is out of the shooter's line of sight.

Depending upon the needs of the shooter, the target carrier may lower the target at any one of a number of selectable positions. In each case, the bullet deflection plates 22 and 23 protect the upper carriage portion 17 by keeping it out of line of sight with the shooter.

Figures 2, 3:
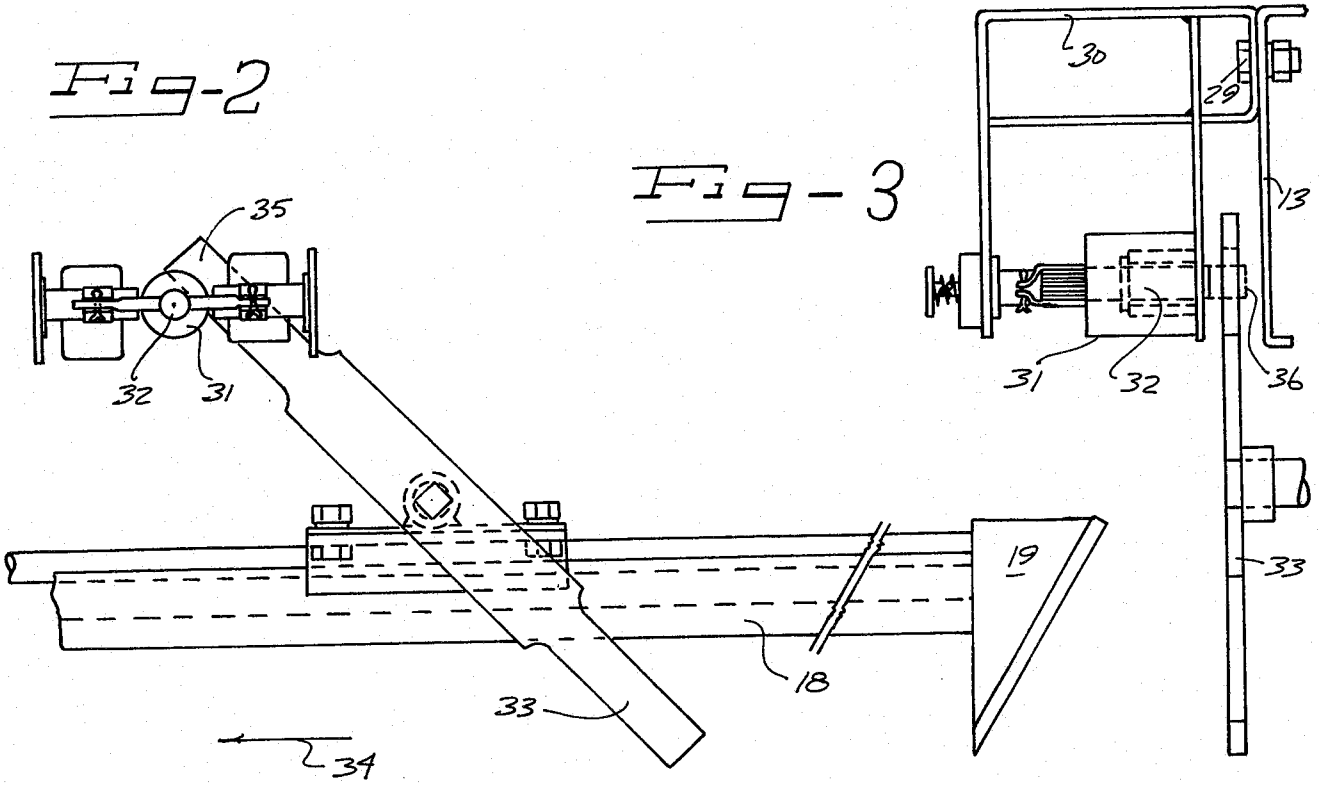
FIG. 2 is an end view of a portion of a mechanism associated with the target carrier to automatically permit the carrier to be lowered at a desired location.
FIG. 3 is a side view showing further detail of the structure illustrated in FIG. 2.

A target carrier system for being moved along a rail such as the rail 11 is known in the prior art, and means are provided in the art for stopping the carriage at given locations along the rail. The present invention includes means for raising and lowering the target portion 18 to be above and clear of the deflection plates 22 and 23. This means may include one of a myriad of defices for accomplishing the same; the means may be mechanical, electrical or a combination of both. For instance, as shown in FIGS. 2 and 3, a mechanical means may be used to lower the target with electrical means being used to provide selectable stops. The target may also be lowered solely by electrical means such as by using an electrical motor to rotate the normally vertical arm 18 to a retracted position, once the target has reached its desired location. This could be accomplished automatically with well known electrical means by having the target portion 18 lowered and raised upon arriving at and leaving a given carriage stop or, the carrier could be lowered under the command of the shooter. In this case, means would be required to assure that the carrier would not be moved along the rail until the target were raised to the retracted position.

Referring to the embodiment shown in FIGS. 2 and 3, one of the rail portions 13 is shown, and mounted to the rail by a bolt 29 is a target carrier stop assembly 30 which includes a solenoid 31. The solenoid 31 has an armature 32 which acts as the target carrier stop. The solenoid and entire stop assembly is rigidly mounted to the rail, and one of these devices would be mounted to each desired position at which the target carrier is required to stop. The movable target carrier may have an arm such as 33 which is connected directly to and rotatable with the depending vertical lower target carrier member 18. Further details of this arrangement are shown in FIG. 3.

In FIG. 3 the arm 33 is shown in an angled relationship with the arm 18 and in a contacting relation with the armature 32 of the solenoid 31. Assuming that the target carrier is moving in the direction of the arrow 34, the upper end 35 of the arm 33 then would contact the armature 32 of the solenoid 31, causing the arm 33 to rotate thereby also rotating the arm 18 of the lower portion of the target carrier to move the target into the final position. The target may then be mechanically raised by any of a suitable number of biasing means. When the carrier is moved away from a location of a solenoid carrier stop assembly, the carrier would automatically raise to the retracted position.

Each of the target carrier stop assemblies would be controlled by the control panel 21 so that the operator could select the target carrier stop assemblies desired to be operated, thereby controlling the location at which the target carrier would be lowered. Once the location is selected, the solenoid would be operated to extend the armature to a position indicated by the dotted line 36 in FIG. 2, thereby providing the necessary stop for the carrier.

It is apparent that different specific means could be used to raise and lower the carrier in place of the specific means shown in FIGS. 2 and 3. However, the spirit and scope of the invention combination as shown in FIG. 1 and set forth in the claims attached hereto contemplate such variations.

I claim as my invention:

1. In a target shooting range having a designated shooter position and a target position, a target carrier system comprising:

a carrier medium extending between the designated shooter position and the target position, a movable target carrier mounted for movement along a path defined by the carrier medium between the shooter position and the target position, said movable target carrier having an upper carriage portion, a lower target holder portion and a suspending system means depending from said upper carriage portion for holding the target holder portion and a target in view of a shooter, a normally stationary protective shield mounted in the shooting range between the shooter position and the target position, said protective shield having an obliquely oriented continuous smooth surface extending perpendicular to the direction of and below said carrier medium, said continuous smooth surface extending to both sides of a vertical line intersecting the mid-point of said carrier medium by a distance which is greater than the amount which any portion of said movable target carrier extends to either side of a vertical line intersecting the mid-point of said upper carriage portion, whereby said upper carriage portion and at least a portion of said suspending means are shielded from the view of a shooter at the shooter position, said target carrier lower target holder portion being movable with respect to said upper carriage portion, and wherein means are provided to move said lower target holder portion into a retracted position above and clear of said normally stationary protective shield while said target carrier is moved between the target and shooter positions.

2. A target carrier system in accordance with claim 1 wherein said lower target holder portion comprises a normally vertical arm depending from the upper carriage portion with means adjacent the lower end thereof for supporting a disposable target and wherein said normally vertical arm is mounted for pivotal movement with respect to said upper carriage portion for being retracted above and clear of said protective shield during movement of the target carrier between shooter and target positions and for being lowered into target position.

3. A target carrier system in accordance with claim 1 wherein said carrier medium is a rigid carrier track and said upper carriage portion of said movable target carrier is a wheeled device movable along the track in response to needs of a shooter for mounting and positioning a target in said target holder.

4. A target carrier system in accordance with claim 1 wherein said protective shield is a bullet deflection plate obliquely positioned between the line of sight of the shooter position and the upper carriage portion when the target carrier is in its target position.

5. A target carrier in accordance with claim 1 wherein said rail is overhead relative to the shooter position and wherein the normally stationary protective shield is a ceiling-mounted shield suspended below said overhead rail.

6. A target carrier system comprises:

a horizontally extending carriage rail mounted in a shooter space, a target carrier vehicle movable along the rail and being designed to support a disposable target, a number of stop positions located along the carriage rail, a shooter position, at least one bullet deflection plate obliquely located between the shooter position and a portion of the target carrier vehicle for deflecting bullets fired by a shooter safely away from that portion of the carrier vehicle, means for raising a target supported by the target carrier vehicle clear of said bullet deflection plate and for transporting the same to and from the shooter to be examined, replaced or returned to a shooting position.

7. A target carrier system in accordance with claim 6 wherein a plurality of said bullet deflection plates are used and a plurality of stop positions are defined between said bullet deflection plates, and said target being capable of being raised and lowered at each of said stop positions.

* * * * *